US007954268B2

(12) United States Patent
Bentley

(10) Patent No.: US 7,954,268 B2
(45) Date of Patent: Jun. 7, 2011

(54) TORSION SPRING RECOIL SYSTEM FOR THE FOREND OF A FIREARM

(75) Inventor: James K. Bentley, Meridian, ID (US)

(73) Assignee: Blackhawk Industries Product Group Unlimited LLC, Norfolk, VA (US)

( * ) Notice: Subject to any disclaimer, the term of this patent is extended or adjusted under 35 U.S.C. 154(b) by 93 days.

(21) Appl. No.: 12/263,656

(22) Filed: Nov. 3, 2008

(65) Prior Publication Data

US 2010/0275483 A1 Nov. 4, 2010

Related U.S. Application Data

(63) Continuation-in-part of application No. 12/008,558, filed on Jan. 11, 2008, now Pat. No. 7,685,755, which is a continuation-in-part of application No. 11/132,872, filed on May 19, 2005, now Pat. No. 7,340,857.

(51) Int. Cl.
*F41A 21/26* (2006.01)

(52) U.S. Cl. ..... 42/1.06

(58) Field of Classification Search ..... 42/1.06, 42/71.01, 72, 90; 89/14.3, 198; 267/182
See application file for complete search history.

(56) References Cited

U.S. PATENT DOCUMENTS

| | | | | |
|---|---|---|---|---|
| 2,104,129 | A | 1/1938 | Kress | |
| 2,498,749 | A * | 2/1950 | Benson | 42/71.01 |
| 2,547,180 | A * | 4/1951 | Taylor | 42/16 |
| 2,826,848 | A * | 3/1958 | Davies | 42/71.01 |
| 4,502,238 | A * | 3/1985 | Farrar et al. | 42/72 |
| 4,514,921 | A | 5/1985 | Burkleca | |
| 5,048,215 | A | 9/1991 | Davis | |
| 5,068,992 | A * | 12/1991 | Velezis et al. | 42/72 |
| 5,417,002 | A * | 5/1995 | Guerra | 42/72 |
| 5,524,374 | A | 6/1996 | Gernstein | |
| 5,722,195 | A * | 3/1998 | Bentley et al. | 42/74 |
| 6,055,760 | A | 5/2000 | Cuson et al. | |
| 6,101,918 | A | 8/2000 | Akins | |
| 7,340,857 | B1 * | 3/2008 | Bentley | 42/1.06 |
| 7,685,755 | B1 * | 3/2010 | Bentley | 42/1.06 |
| 2005/0241206 | A1 * | 11/2005 | Teetzel et al. | 42/72 |
| 2007/0199224 | A1 * | 8/2007 | Bentley | 42/72 |
| 2009/0084016 | A1 * | 4/2009 | Wu | 42/90 |
| 2009/0313873 | A1 * | 12/2009 | Roth | 42/72 |

OTHER PUBLICATIONS

"OA from US7340857 dtd Feb. 27, 2007".
USPTO, "Final Office Action for U.S. Appl. No. 12/008,558 dated Aug. 20, 2009".
USPTO, "Non Final Office Action in U.S. Appl. No. 12/008,558 dated Feb. 20, 2009".

* cited by examiner

*Primary Examiner* — Bret Hayes
(74) *Attorney, Agent, or Firm* — Zarian Midgley & Johnson PLLC

(57) ABSTRACT

A recoil reduction system for use with firearms. The recoil reduction system includes a cam coupled with a torsion spring which can provide resistance to a sliding member of a firearm, thus reducing recoil. The torsion spring and cam can be used as part of a recoil reduction system that is installed in a handgrip or in a forend. Accessories may be attached to the recoil reduction mechanism in order to gain the benefits of recoil reduction.

20 Claims, 16 Drawing Sheets

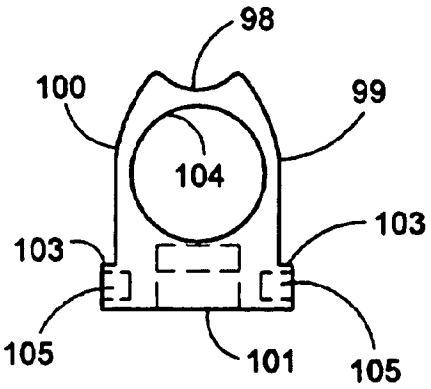
FIG. 15
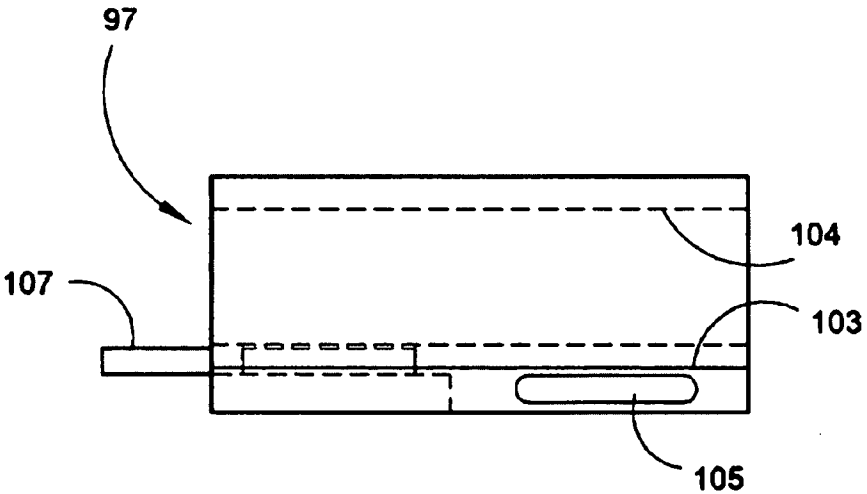
FIG. 14
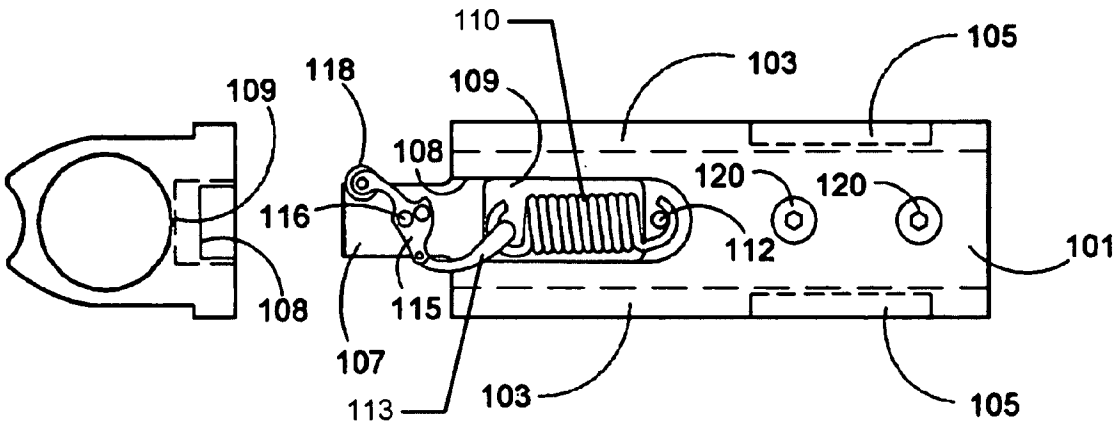
FIG. 17
FIG. 16

TORSION SPRING RECOIL SYSTEM FOR THE FOREND OF A FIREARM

CROSS REFERENCE TO RELATED APPLICATIONS

This application is a continuation-in-part application of U.S. patent application Ser. No. 12/008,558, filed Jan. 11, 2008 now U.S. Pat. No. 7,685,755 entitled "Recoil System," which is a continuation-in-part of U.S. patent application Ser. No. 11/132,872, filed May 19, 2005, now U.S. Pat. No. 7,340, 857 entitled "Recoil System For The Forend Of A Firearm," both of which are incorporated herein in their entireties by reference.

BACKGROUND OF THE INVENTION

The invention relates to firearms and more specifically to a recoil system for rifles and shotguns. One age-old problem that has existed with firearms is the fact that many of them have severe recoil that affects the person firing the weapon. In firearms such as shotguns and rifles, the rear end of the butt stock is positioned against the shooter's shoulder. When discharged, the recoil from the discharge applies a centrifugal force to the firearm, often causing the front of the firearm to rise. Also, recoil varies depending upon the amount of explosive being fired and the recoil can result in pain and/or bruising to the shoulder area of the person firing the weapon. One example of the recoil being detrimental to a shooter's accuracy is where the firearm is a shotgun being used for skeet shooting by a male or a female.

In the past, the best prior art recoil systems for the butt stock of a firearm have been very expensive and the inexpensive systems did not function properly. Two examples of expensive systems are a hydro-coil fluid dampening system and a pneumatic air chamber system. The present inexpensive recoil systems utilize compression coil springs to absorb the recoil forces. If the compression coil spring is a little too strong, you get more recoil than with a regular firearm. If the compression coil spring is not strong enough it is worse, in that it gives the gun some travel and it is the same as holding the butt stock too loosely.

One improvement in recoil systems for a firearm is illustrated in the Bentley et al U.S. Pat. No. 5,722,195. It has a pistol grip recoil assembly having a recoil base member and a pistol grip. The recoil base member is detachably secured to the rear end of the receiver of the firearm and it has an inverted T-shaped rail formed on its bottom wall. This inverted T-shaped rail is captured within and slides in an inverted T-shaped groove in the top end of the pistol grip. A recess formed in the front wall of the pistol grip adjacent its top end allows the trigger guard of the firearm to travel rearwardly with respect to the pistol grip when the firearm is fired. Various embodiments utilize springs to return the recoil base member forwardly to its static position after dissipating the recoil of the firearm resulting from its being fired.

Another recent improved recoil system for a firearm is illustrated in the Bentley et al U.S. Pat. No. 5,752,339. This patent discloses a recoil system for the butt stock of a firearm having a recoil suppressor assembly whose front end is mounted in the cavity in the rear end of the gun stock. The piston ram of the recoil suppressor assembly in its static position extends rearwardly into a bore hole cavity of a elongated recoil housing. When the firearm is shot, the elongated body portion of the recoil suppressor assembly and its transversely extending mounting flange portion instantaneously travel rearwardly into the bore cavity with the bore hole of the body housing reciprocally traveling over the piston ram. A coil spring whose front end is secured to the front end of the body portion whose rear end is secured to a cam assembly returns the elongated body portion to a static position once the recoil of the firearm has been suppressed.

Previous recoil systems have had success, but also have some inherent drawbacks. For example, many firearms have various mechanisms located in the stock, such as a bolt return spring, that precludes the use of a recoil system located in the stock. Further, many traditional recoil systems are too large to be used within the forend of a firearm that does not employ the use of "Kelly" or pistol grips.

Additionally, previous recoil systems are generally bulky, typically substantially filling a cavity that might fit within an average handgrip. Previous recoil systems have also employed spring and lever assemblies that use spring elements, such as a compression or extension springs, that require linear travel paths separate from that of the lever. These spring elements may also have an inherent rebound, adding vibration or bounce to the motion of a firearm upon discharge. This vibration or bounce may at best reduce the accuracy of a marksman when multiple discharges of the firearm are required and at worst result in pain or injury to a shooter.

Previous recoil systems that have rebound may include a dampening mechanism to minimize or reduce the effects of the rebound felt by the shooter. Such dampening mechanisms add cost and complexity to the system and reduce the amount of energy stored by a recoil reduction spring system which may reduce the spring systems ability to return the firearm to its initial pre-discharge configuration.

It would be beneficial to provide a recoil reduction system that can be used within the forend of a firearm.

It would be beneficial to provide a recoil reduction system that can be used within a handgrip attached to the forend of a firearm.

It would be beneficial to provide a recoil reduction system that has no rebound.

It would be beneficial to provide a compact recoil reduction system that can be used within smaller firearms designed for young or smaller statured shooters.

It would be beneficial to provide a recoil reduction system that does not require dampening.

It would be beneficial to provide a recoil reduction system that can use the full energy of a discharge for dampening the recoil and returning the firearm to its pre-discharge configuration.

The present invention is directed to overcoming, or at least reducing the effects of one or more of the issues set forth above.

SUMMARY

One embodiment of the invention is a recoil reduction system comprising a handgrip member having a top end, bottom end, and a chamber that extends within the handgrip member. A track is formed in the top end of the handgrip member and a sliding member is slidably connected to the track. A recoil reduction means is mounted within the chamber, which comprises a torsion spring connected to a cam. The recoil reduction means of the recoil reduction system is configured to oppose sliding by the sliding member in at least one direction The recoil reduction system may be connected to a firearm. The sliding member of the recoil reduction system may be a rail. The torsion spring and cam may be configured to pivot about the same axis. The torsion spring may comprise an open end, a closed end, and at least two coils. Alternatively, the torsion spring may comprise a first end, a second end, and at least one coil between the first and second ends. The recoil reduction means may have substantially no linear rebound. The cam may comprise a profile that is adapted to engage the torsion spring. The recoil reduction system may have substantially no linear rebound. The handgrip member may have at least one accessory mount connected to the handgrip member. A light, sight, scope, laser sight, or bipod may be connected to at least one of the accessory mounts of the recoil reduction system.

Another embodiment is a recoil reduction system comprising an elongated forend having a front end, a rear end, a left side wall, a right side wall, a bottom wall, a top end, a recess formed therein, and a track formed in the top end. A sliding member may be slidably connected to the track and a recoil reduction means may be mounted within the recess of the forend. The recoil reduction means may comprise a torsion spring connected to a cam and may be configured to oppose sliding by the sliding member in at least one direction.

The forend may further comprise a handrest stop extending down from the bottom wall of the forend, which may have a recess formed within it. The recoil reduction means may be installed within the recess of the handrest stop.

Another embodiment is a recoil reduction structure comprising a cam having a first end, a middle, and a second end, a pivot pin pivotally securing the cam to a firearm and creating a pivot point, a sliding member that is slidably connected to the firearm, and a torsion spring connected to the cam. The torsion spring and cam assembly may be configured to oppose sliding by the sliding member in at least one direction.

The firearm may further comprise a receiver having a front end and a rear end, an elongated gun barrel having a front end and a rear end where the rear end of the gun barrel is connected to the front end of the receiver, an elongated magazine for shells where the magazine has a front end and a rear end where the rear end of the magazine is connected to the front end of the receiver, an elongated forend which has a front end, a rear end, a left side wall, a right side wall and a bottom wall, and an upright oriented handgrip having a top end, a bottom end, a front end, and a primary chamber that extends upwardly within the handgrip. A track may be formed in the top end of the handgrip. The sliding member of the recoil reduction structure may comprise a longitudinally extending rail and may be connected to the bottom surface of the forend. The rail may be slidably received in the track to support the handgrip and the cam, pivot pin, and the torsion spring may be mounted in the primary chamber of the handgrip.

These and other embodiments of the present application will be discussed more fully in the description. The features, functions, and advantages can be achieved independently in various embodiments of the claimed invention, or may be combined in yet other embodiments.

BRIEF DESCRIPTION OF FIGURES

FIG. 14 is a side elevation view of the support unit for the recoil reduction structure received in the forend illustrated in FIGS. 11-13;

FIG. 15 is a front elevation view of the support unit illustrated in FIG. 14;

FIG. 16 is a rear elevation view of the support unit illustrated in FIG. 14;

FIG. 17 is a bottom plan view of the support unit illustrated in FIG. 14;

Like reference numbers and designations in the various drawings indicate like elements.

DETAILED DESCRIPTION

In the following description, reference is made to the accompanying drawings that form a part thereof, and in which is shown by way of illustration specific exemplary embodiments in which the invention may be practiced. These embodiments are described in sufficient detail to enable those skilled in the art to practice the invention, and it is to be understood that modifications to the various disclosed embodiments may be made, and other embodiments may be utilized, without departing from the spirit and scope of the present invention. The following detailed description is, therefore, not to be taken in a limiting sense.

Figure 1:
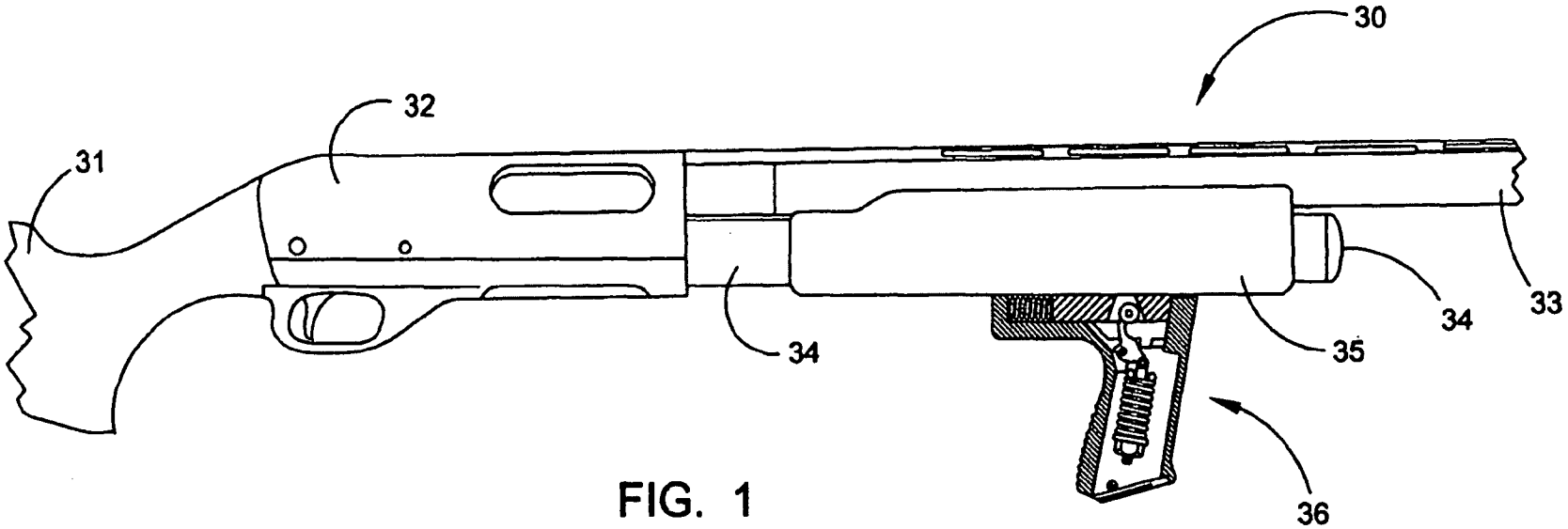
FIG. 1 is a side elevation view of a shotgun illustrating the recoil reduction system mounted in a handgrip member secured to the bottom of the forend.
Figure 5:
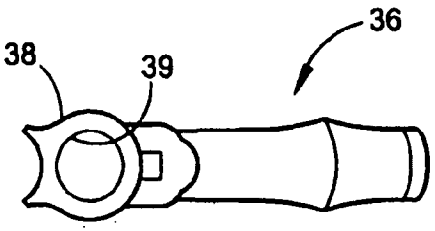
FIG. 5 is a front elevation view of FIG. 2.
Figure 3:
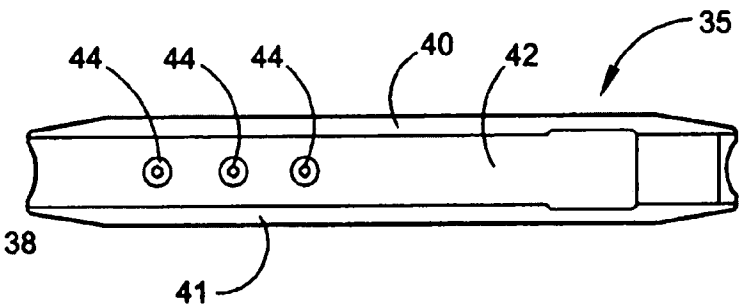
FIG. 3 is a top plan view of the forend illustrated in FIG. 2.

The novel recoil reduction system for a firearm will now be described by referring to FIGS. 1-9 and 18-19. A shotgun 30 is illustrated in FIG. 1 having a butt stock 31, a receiver 32, a gun barrel 33, a magazine 34, a forend 35 and a handgrip member 36. The recoil reduction system is mounted within handgrip member 36.

Figure 4:
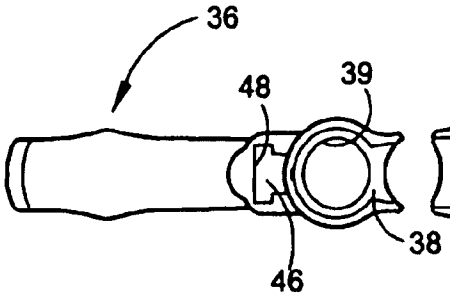
FIG. 4 is a rear elevation view of FIG. 2.
Figure 2:
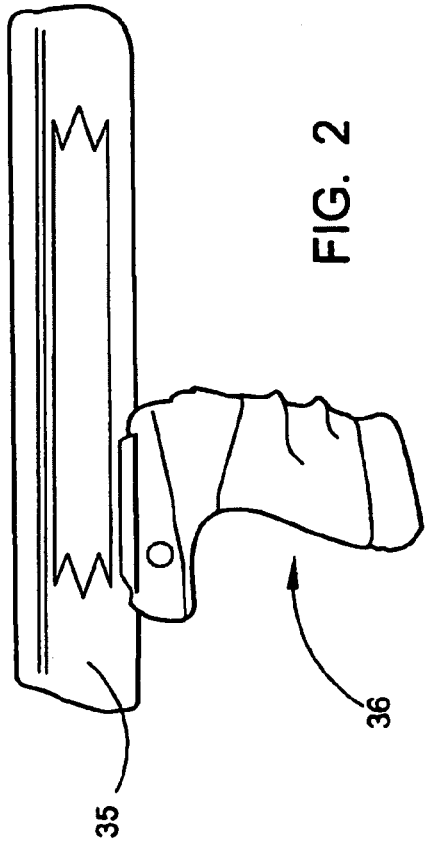
FIG. 2 is an enlarged side elevation view of a forend having the recoil reduction system mounted in the handgrip member.
Figure 6:
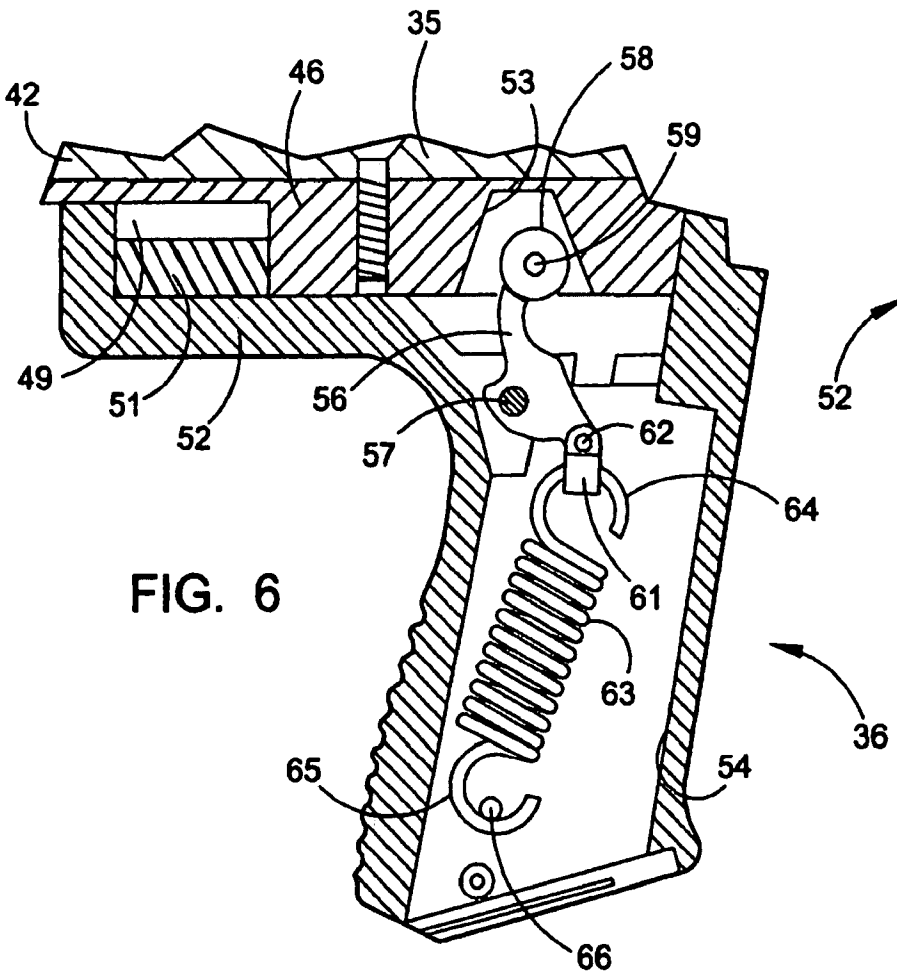
FIG. 6 is a vertical cross section view illustrating a first embodiment of the recoil reduction system mounted in the handgrip member.

FIGS. 1-6 and 18-19 illustrate views of the forend 35 from various sides and angles. FIG. 4 is a rear elevation view and it shows that forend 35 has a generally U-shaped transverse profile with a ring 38 formed at its front end. Ring 38 has a bore hole 39 that would telescope over magazine 34, as shown in FIG. 1. The remainder of forend 35 has a left side wall 40, a right side wall 41 and a bottom wall 42. A plurality of screws 44 secure an inverted T-shaped rail 46 to the bottom surface of forend 35. Handgrip member 36 has a longitudinally extending inverted T-shaped track 48 along which rail 46 reciprocally travels. Track 48 has a chamber 49 (shown in FIG. 6) formed in its rear end that receives an elastomer block 51 having a cylindrical shape. Track 48 and chamber 49 are formed in track housing 52 that extends rearwardly from the top end of handgrip member 36. As shown in FIG. 6, a cavity 53 is formed in the bottom surface of rail 46. A primary chamber 54 extends upwardly through almost all of the height of handgrip member 36. A lever 56 is pivotally mounted in primary chamber 54 by a pivot pin 57. A cam roller 58 is mounted on the top end of lever 56 by a pin 59. A retainer ring 61 is mounted on the bottom end of lever 56 by a pin 62. A coil spring 63 has its top hook member 64 captured in retainer 61. Coil spring 63 has a bottom hook member 65 captured by the rigid pin 66.

Forend 35 is rigidly secured to the magazine 34 or other structure that is rigidly secured to receiver 32. When the shotgun is fired, a forend 35 recoils rearwardly causing rail 46 to also travel in the same direction. The elastomer block 51 is compressed to reduce some of the recoil. Cam roller 58 is pivoted rearwardly about pivot pin 57 causing coil spring 63 to be stretched and then returned to its static position and this also provides recoil reduction.

Figure 7:
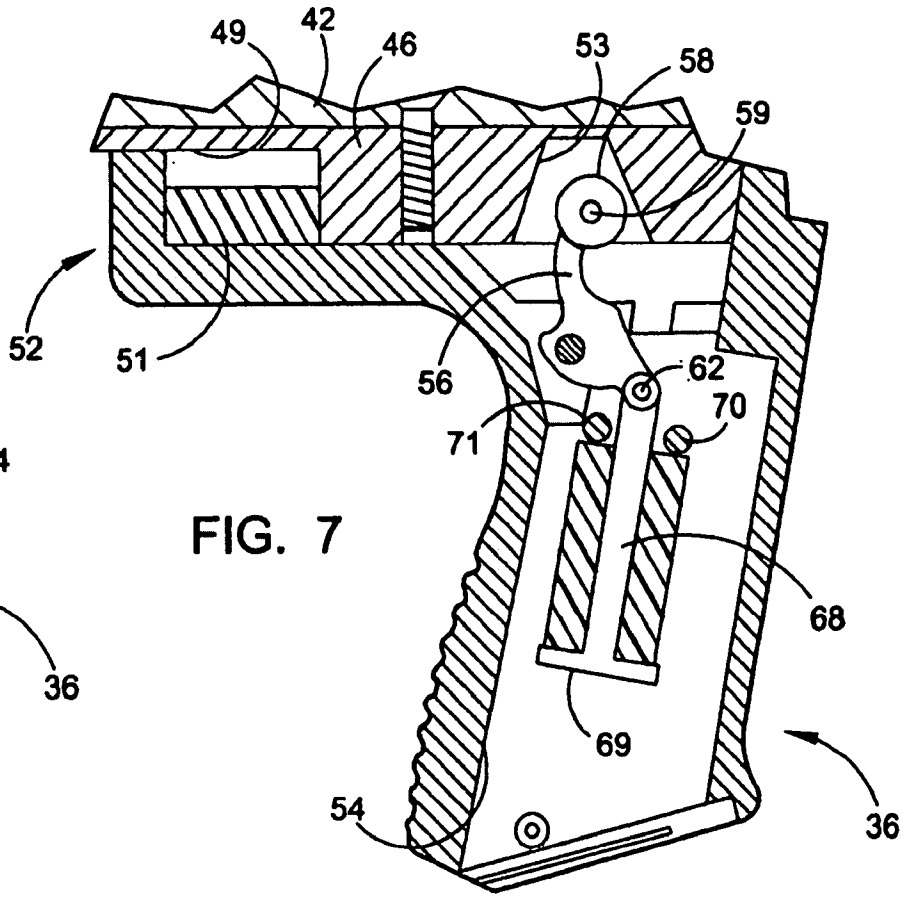
FIG. 7 is a vertical cross section view illustrating a second embodiment of the recoil reduction system mounted in the handgrip member.

A first variation of the recoil reducing structure in the handgrip member 36 is illustrated in FIG. 7. A rod 68 has its bottom end connected to plate 69 and its top end is pivoted on pin 62. An elastomer tube 72 is telescoped over rod 68 and its top end bears against pins 70 and 71. Rearward travel of rail 46 will pivot lever 56 rearwardly causing elastomer tube 72 to be compressed and reduce recoil.

Figure 8:
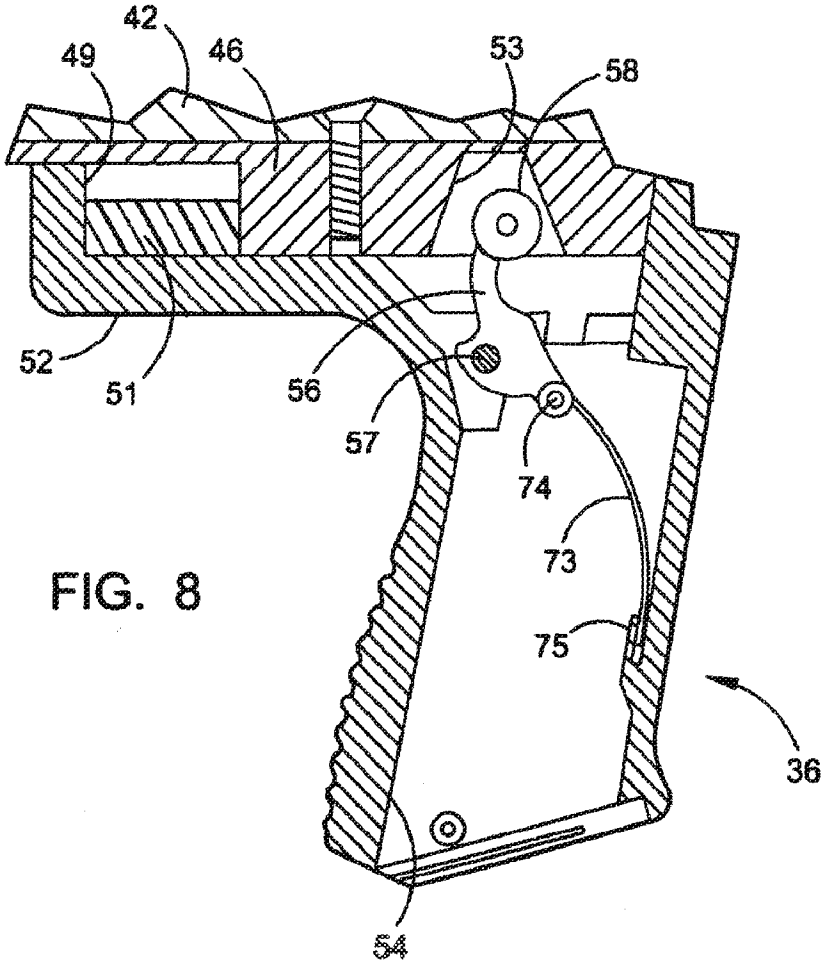
FIG. 8 is a vertical cross section view illustrating a third embodiment of the recoil reduction system mounted in the handgrip member.

A second alternative recoil reducing structure is illustrated in FIG. 8. It has a leaf spring 73 having a stressed curvature in its static state. Its top end is captured by attachment structure 74 on the bottom end of lever 56 and its bottom end is captured in slot 75 in the inner wall of handgrip member 36. Rearward travel of rail 46 will compress elastomer block 51 causing recoil reduction. Likewise spring 73 will be stretched upwardly when lever 56 is rotated rearwardly. This also reduces the recoil force.

Figure 9:
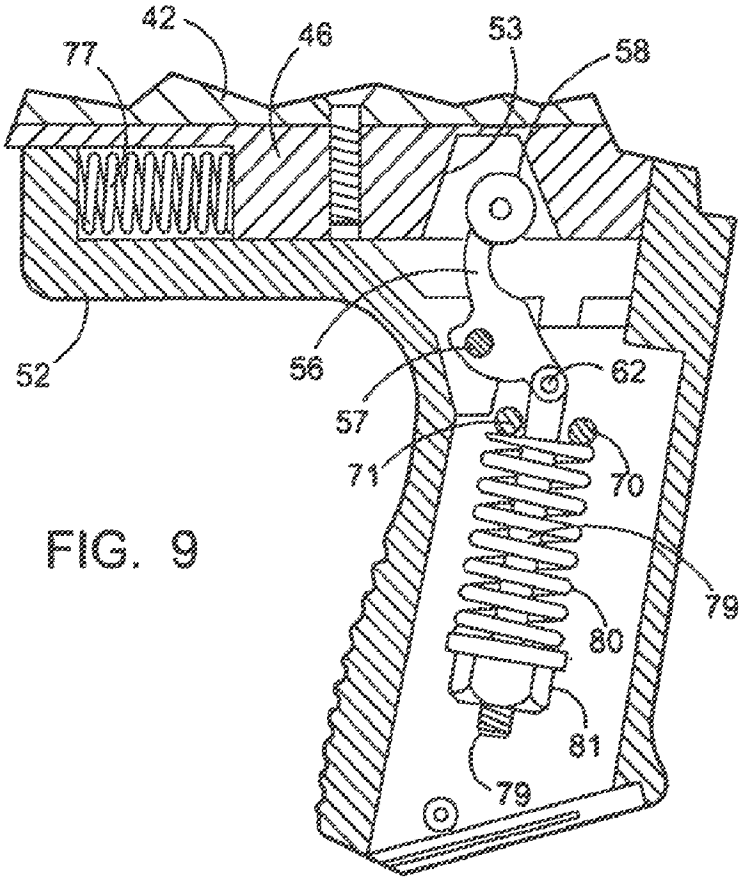
FIG. 9 is a vertical cross section view illustrating a fourth embodiment of the recoil reduction system mounted in the handgrip member.

A third alternative recoil structure is illustrated in FIG. 9. It has a coil spring 77 in rail chamber 49. A screw 79 has its top end captured by pin 62. A coil spring 80 surrounds screw 79 and has a nut 81 on its bottom end. Pins 70 and 71 press against the top end of spring 80. When rail 46 travels rearwardly, coil spring 77 reduces the recoil force. Also as lever 56 has its top end pivoted rearwardly, spring 80 would be compressed to also reduce recoil force.

Figure 10:
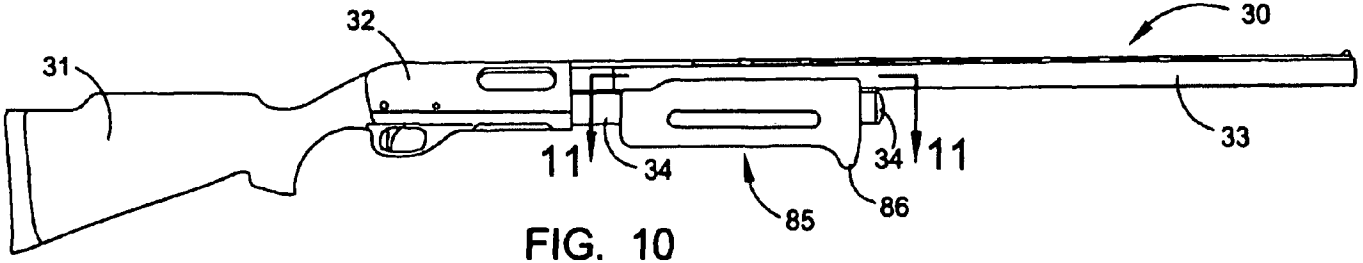
FIG. 10 is a side elevation view of a shotgun illustrating the recoil reduction system mounted within the interior of the forend member.
Figure 11:
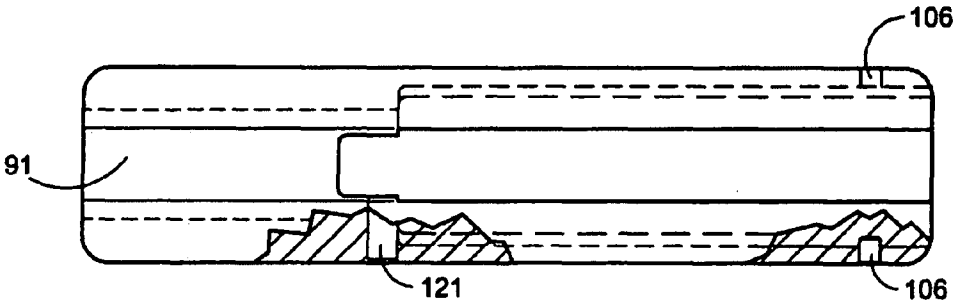
FIG. 11 is a top plan view of the forend member illustrated in FIG. 10.
Figure 12:
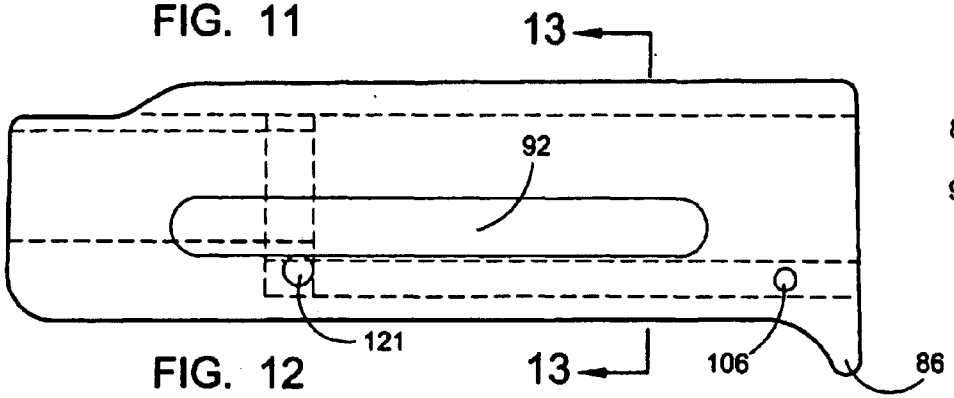
FIG. 12 is a right side elevation view of the forend member illustrated in FIG. 10.
Figure 13:
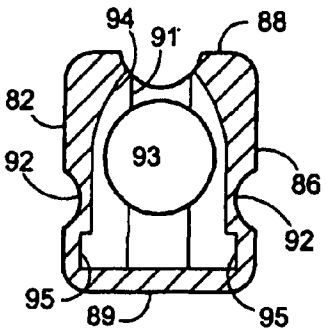
FIG. 13 is a cross sectional view taken along lines 13-13 of FIG. 12.
Figure 19:
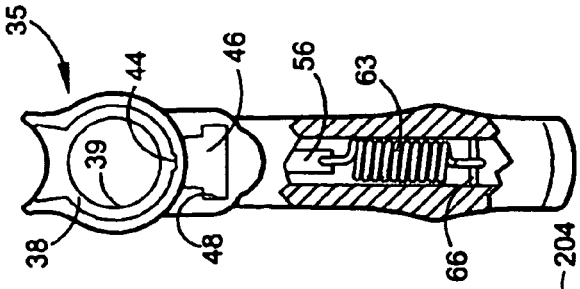
FIG. 19 is a front elevation view of FIG. 18 with portions shown in cross section.
Figure 18:
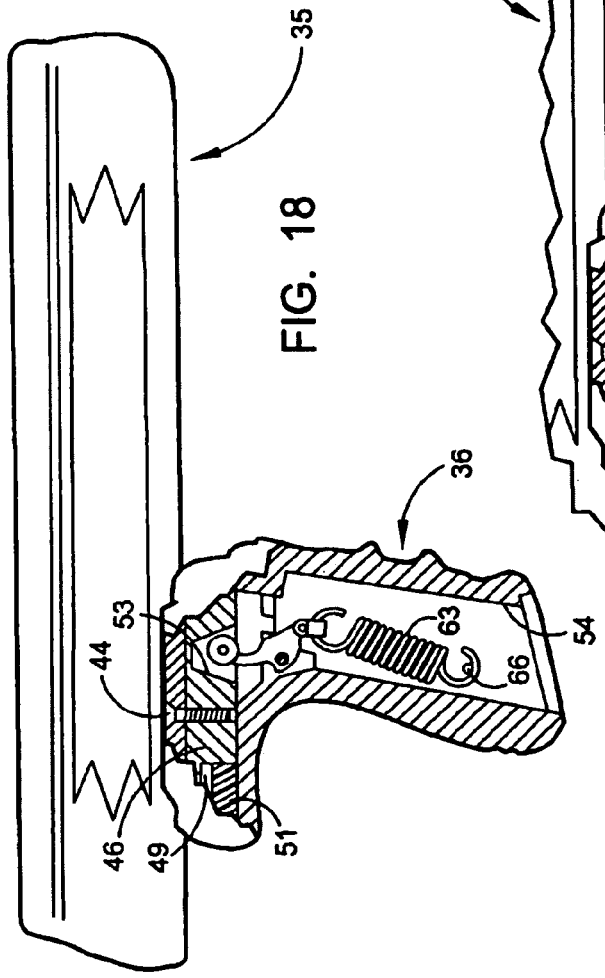
FIG. 18 is an enlarged view of FIG. 2 with portions of the handgrip member illustrated in cross section.

In FIGS. 10-17, the recoil reduction system is mounted inside forend 85. Forend 85 has a handrest stop 86 extending downwardly from its forward end to prevent the shooter's hand from slipping off the forend. FIGS. 11-13 illustrate different views of the forend 85. As shown in FIG. 13, forend 85 is generally U-shaped throughout most of its length. It has a left side wall 86, a right side wall 82, a top wall 88, and a bottom wall 89. A portion of forend 85 has a connecting wall member 91 at its top end and a bore hole 93 is formed for telescopically receiving the magazine 34 (shown in FIG. 10). Finger grooves 92 are formed along the outside surface of the respective left and right side walls. Forend 85 has an interior cavity 94 having outwardly extending tracks 95 adjacent its bottom end.

The structure for mounting the recoil reduction system is illustrated in FIGS. 14-17, and is generally identified as support unit 97. Support unit 97 is a solid piece of material that is telescopically received in cavity 94 (shown in FIG. 13) of forend 85 as shown in FIG. 10. Support unit 97 has a top wall 98, a left side wall 99, a right side wall 100, a bottom wall 101 and rails 103 extend outwardly from the respective side walls adjacent bottom wall 101. A bore hole 104 extends the length of support unit 97 so that it telescopes over magazine 34 as shown in FIG. 10. Grooves 105 extend inwardly into rails 103 and these grooves receive set screws 106 (shown in FIGS. 11 and 12) extending inwardly from the side walls of forend 85. Bottom wall 101 is best seen in FIG. 17. As shown in FIG. 17, it has a tongue 107 extending from its front end. An outer cavity 108 is formed in bottom wall 101 for receiving part of the hardware of the recoil reduction system. A second deeper cavity 109 accommodates the bottom portion of coil spring 110. One end of coil spring 110 is secured to a pin 112 and the other end is secured to a retainer member 113 whose free end is secured to one end of lever 115. Lever 115 is secured to tongue 107 by a pivot pin 116. A cam roller 118 is supported by a pin on the other end of lever 115. Attachment screws 120 secure support unit 97. As support unit 97 travels rearwardly, cam roller 118 engages pin 121 (shown in FIG. 12) extending into the side wall of forend 85. It engages cam roller 118 causing it to rotate about pivot pin 116 causing spring 110 to be stretched and reduce recoil.

Figure 20:
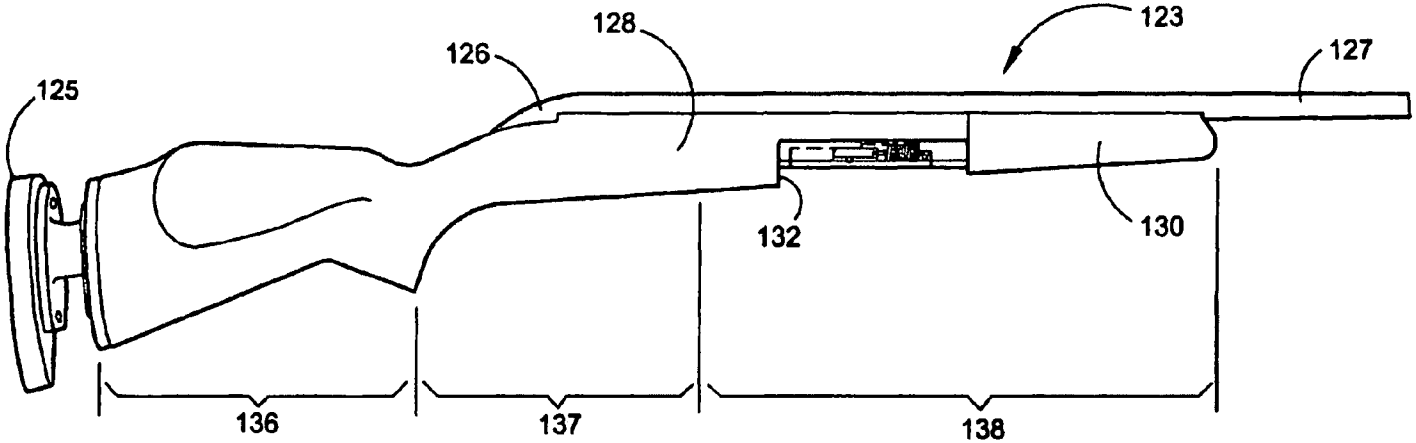
FIG. 20 is a side elevation view of a rifle having the recoil reduction system positioned forwardly of the receiver in the bottom of the long gun stock.
Figure 21:
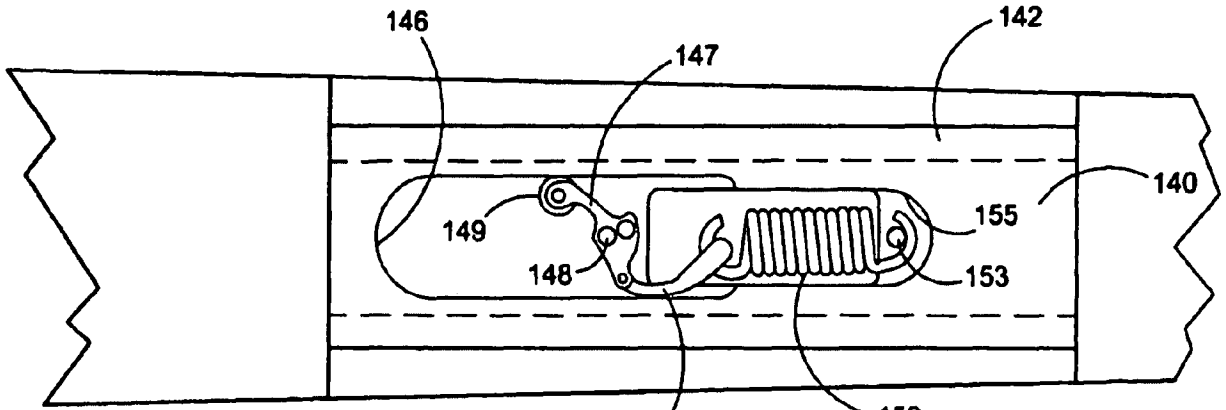
FIG. 21 is a partial bottom plan view of FIG. 20.

In FIGS. 20-24, the recoil reduction system is mounted in a rifle 123. As shown in FIG. 20, rifle 123 has a recoil suppression butt stock assembly 125, a receiver 126, a gun barrel 127 and a long gun stock 128. For the embodiment to be discussed, long gun stock 128 would have a removable front piece 130. It is to be understood that a single long gun stock 128 could also have primary recess 132 integrally formed in a single long gun stock. In the illustrated embodiment, stock cover 134 (not shown) can only be installed by removing front piece 130. Long gun stock 128 has three identifiable portions, butt stock portion 136, middle portion 137 and front portion 138. Front portion 138 is located forward of receiver 128. Primary recess 132 has a bottom wall 140. Bottom wall 140 has rails 142 extending along its lateral edges and above it are formed an inwardly extending track 144 (not shown). A recess 146 is formed in bottom wall 140 and lever 147 is mounted on a pivot pin 148 therein. A cam roller 149 is pivotally secured to one end of lever 147. A retainer member 150 is secured to the other end of 147 and it captures one end of spring 152. The other end of spring 152 is captured by a pin 153. The top portion of spring 152 extends into a deeper recess 155.

Figure 22:
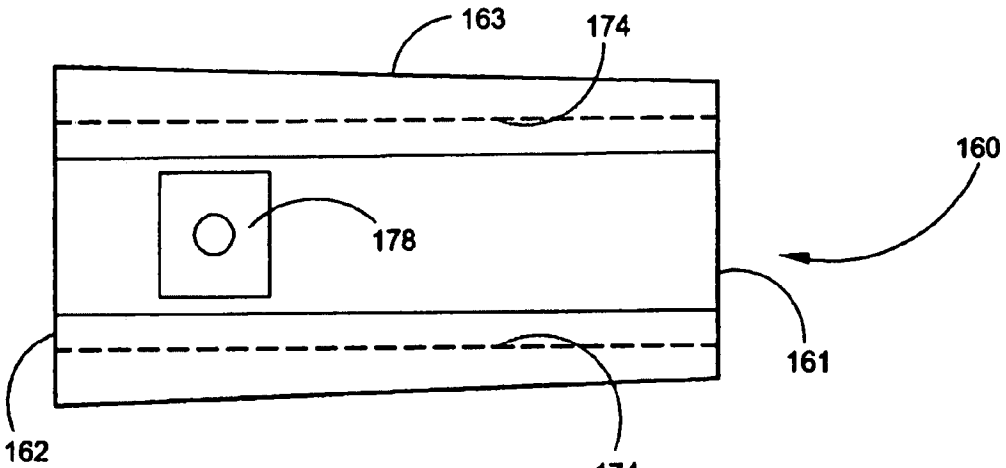
FIG. 22 is a top plan view of the cover member.
Figure 24:
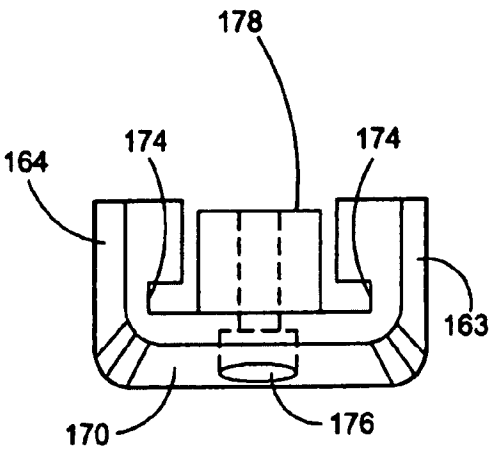
FIG. 24 is a front elevation view of the cover member.
Figure 23:
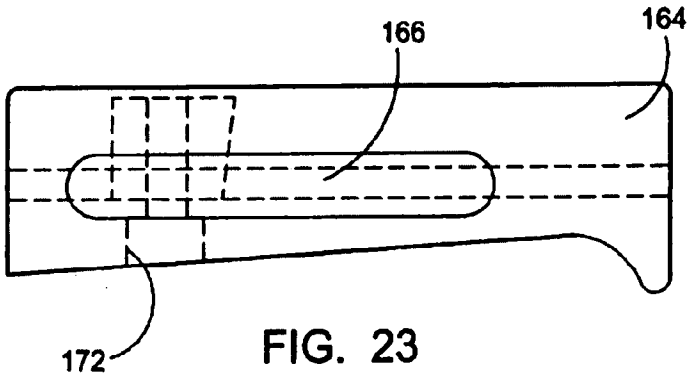
FIG. 23 is a side elevation of the cover member.

As shown in FIG. 22, a cover member 160 has a front end 161, a rear end 162, a left side wall 163 and a right side wall 164. Finger grips 166 (shown in FIG. 23) are formed in both of the side walls 163 and 164. Cover member 160 has a bottom wall 170 (shown in FIG. 23) having a bore hole 172 therein. Tracks 174 are formed on the inner side wall surfaces and they telescopically receive rails 142 (shown in FIG. 21). A screw 176 (shown in FIG. 24) extends upwardly through bore hole 172 (show in FIG. 23) and is threaded into the bottom end of a tapered nut 178. Once cover 160 is slid onto rails 142, screw 176 is tightened which causes tapered nut 178 to push upwardly until it contacts cam roller 149 (shown in FIG. 21) and preloads spring 152. The length of cover member 160 is about 1 inch short of the length of primary recess 132. When the rifle is fired, long gun stock 128 will travel rearwardly while cover member 160 is held stationary by the forward hand of the person holding the rifle. Cam roller 149 will contact tapered nut 178 causing lever 147 to pivot forwardly causing spring 152 to be stretched thereby reducing the recoil force.

Figure 25:
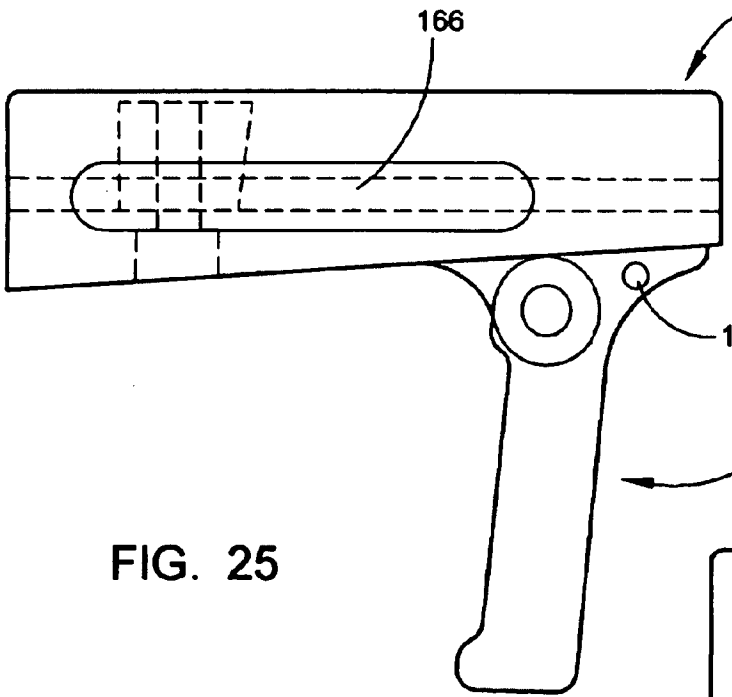
FIG. 25 is a side elevation view of an alternative embodiment of the cover member having a retractable handgrip member secured to its bottom surface.
Figure 26:
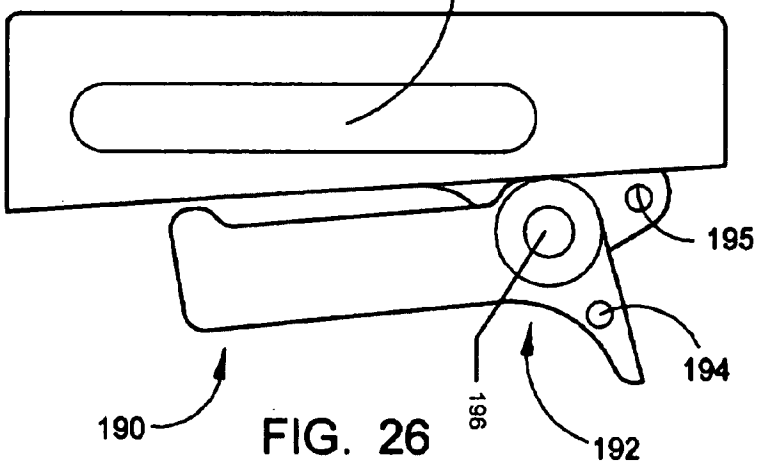
FIG. 26 is a side elevation view of the alternative cover member showing the handgrip member in its retracted position.

In FIGS. 25 and 26, cover member 160 is illustrated as having a handgrip member 190 with its top end pivotally secured to hinge assembly 192. Handgrip member 190 rotates around pivot pin 196 to its retracted position. When handgrip member 190 is in its down position, bore holes 194 and 195 align to receive a locking pin 197.

Figure 27:
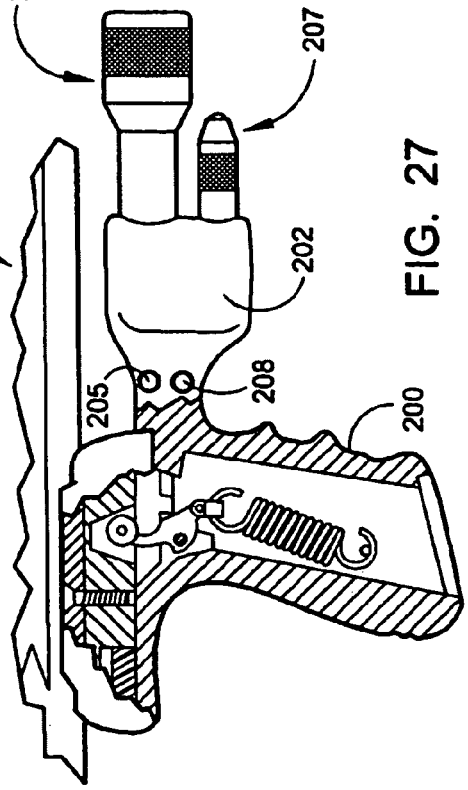
FIG. 27 is a side elevation view illustrating a flashlight and a laser light mounted on the front end of a handgrip member.

FIG. 27 is a side elevation view illustrating a flashlight and a laser light mounted on the front end of a handgrip member.

Figure 28:
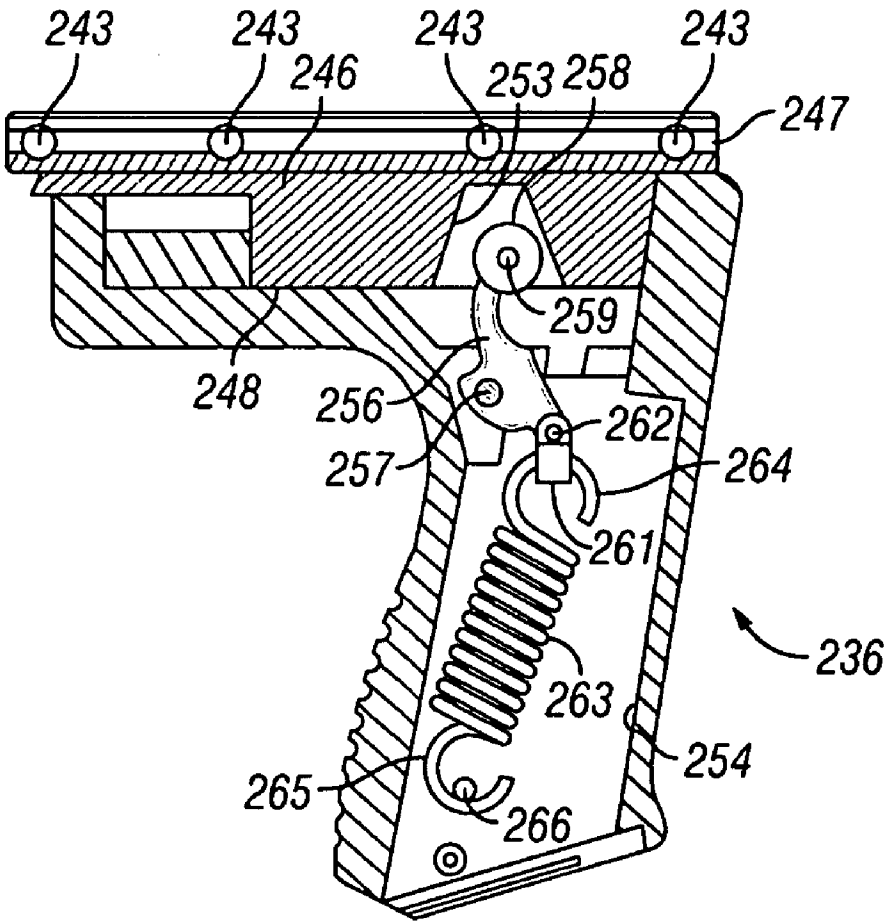
FIG. 28 is a vertical cross section view illustrating an embodiment of the recoil reduction system mounted in the handgrip member, and having a rail mount receiver connected to the top end of the handgrip member.

FIG. 28 is a side view of a recoil reduction system, in accord with one embodiment of the current disclosure. The recoil reduction system comprises a handgrip member 236, a track 248 formed in the top end of the handgrip member 236, a chamber 254 extending within the handgrip member 236, and a recoil reduction means mounted within the chamber 254. The recoil reduction system may further comprise a rail 246 slidably connected to the track 248 of the handgrip member 236. The recoil reduction means may be configured such that rearward travel by the rail 246 is opposed. It is conceived that the rail 246 may be combined with a traditional member of a firearm, such as a forend.

As shown in FIG. 28, a cavity 253 is formed in the bottom surface of the rail 246. The primary chamber 254 extends upwardly through the handgrip member 236. A lever 256 is pivotally mounted in the primary chamber 254 by a pivot pin 257. A cam roller 258 is mounted on the top end of the lever 256 by a pin 259. A retainer ring 261 is mounted on the bottom end of the lever 256 by a pin 262. A coil spring 263 has a top hook member 264 captured in the retainer ring 261. The coil spring 263 has a bottom hook member 265 captured by a rigid pin 266.

Figure 29:
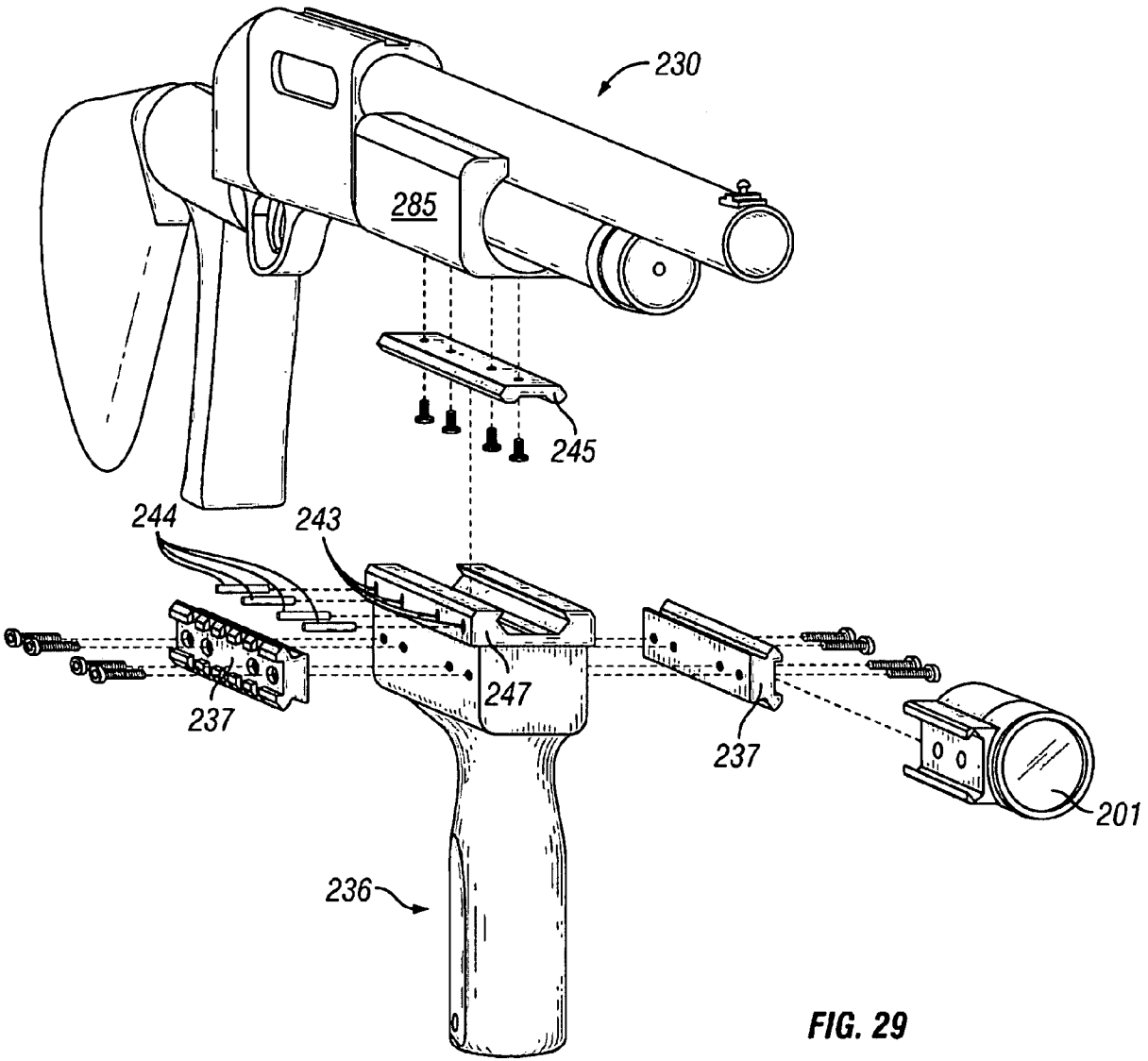
FIG. 29 is an exploded perspective view of a firearm connected to a recoil reduction system with a rail mount.

The recoil reduction system may also comprise a mounting means. The mounting means may comprise a member, such as a rail mount receiver 247, as shown in FIG. 28. The mounting means may be configured to connect to a rail mount 245 (shown in FIG. 29), such as a picatinny rail, weaver rail, or universal rail. For example, the rail mount receiver 247 can slidably receive a rail mount 245. The rail mount receiver 247 may have a plurality of openings 243 on the side walls of the rail mount receiver 247 and may be secured to the rail mount 245 by one or more rigid pins 244 inserted into the openings 243, as shown in FIG. 29. The pins 244 may be sized and positioned such that, when inserted, they substantially fill the slots of the rail mount 245 and are in contact with both side walls of the rail mount receiver 247, substantially securing the rail mount receiver 247 to the rail mount 245. Other mounting means, such as a "rail grabber", would be apparent to one of ordinary skill in the art given the benefit of this disclosure.

Some embodiments of a recoil reduction system may further comprise one or more accessory mounts 237, as shown in FIG. 29. The accessory mount 237 may be a rail mount such as a picatinny rail, a weaver rail, or a universal rail. An Accessory 201, such a light or an aiming device, may be mounted to the recoil reduction system through an accessory mount 237. Mounting an accessory 201 advantageously allows it to gain the benefits of recoil reduction. For example, filament lights have long been used with firearms to illuminate the area in which the gun is aimed. Filament lights are problematic though, as they are often fragile and can be damaged by recoil when connected to a firearm. However, when a filament light is attached to a firearm through an accessory mount 237 of a recoil reduction system, the light may experience less recoil and therefore may be less likely to be damaged. Further, reduced recoil may allow for greater marksmanship, as recoil may inhibit aim, for example, when multiple accurate discharges are desired. Increased accuracy due to the addition of a recoil reduction system may be particularly apparent when used in conjunction with an accessory 201 that is intended to increase accuracy, such as a sight, scope, bipod, or laser sight. Other accessories 201 that would benefit from use with a recoil reduction system would be apparent to one of ordinary skill in the art given the benefit of this disclosure.

FIG. 29 is a perspective exploded view of one embodiment of a recoil reduction system as it may be connected to the forend 285 of a firearm 230, such as a shotgun or rifle. The recoil reduction system comprises a recoil reduction means mounted within a handgrip member 236. The mounting means of the recoil reduction system may be further connected to a firearm 230 connecting means. For example, a rail mount receiver 247 and a rail mount 245 set may be used for the connection. The rail mount may be a picatinny rail, weaver rail, or universal rail. In the embodiment illustrated in FIG. 29, the handgrip member 236 further comprises two accessory mounts 237, such as rail mounts, and has an accessory 201, such as a light, connected to one of the accessory mounts 237. The accessory 201 may be connected to the accessory mount 237 with a complementary attachment member, such as a rail mount receiver or a rail grabber.

Figure 30:
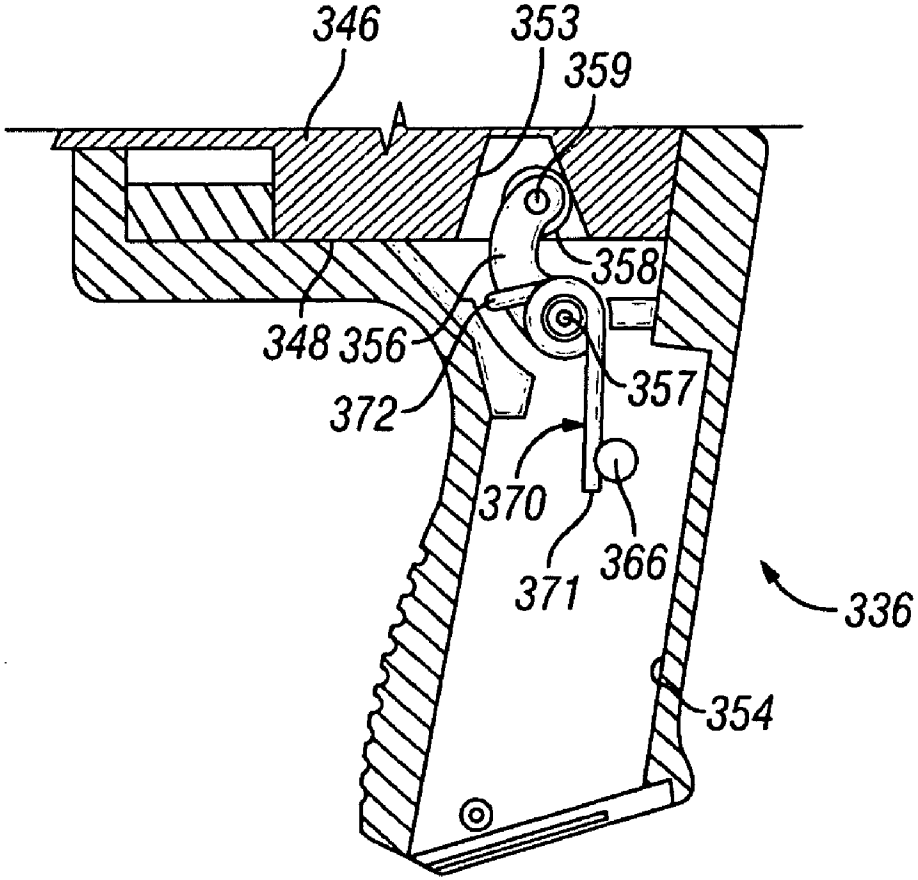
FIG. 30 is a vertical cross section view illustrating an embodiment of the recoil reduction system with a cam and torsion spring, mounted in a handgrip member.

FIG. 30 is a cut away side view illustrating one embodiment of a recoil reduction system comprising a recoil reduction means connected to a handgrip member 336. The recoil reduction means shown in FIG. 30 comprises a cam 356 pivotally mounted in a chamber 354 of the handgrip member 336 by a pivot pin 357. The handgrip member 336 may further comprise a track 348 formed in the top end of the handgrip member 336 and a rail 346 slidably connected to the track 348.

Figure 32A:
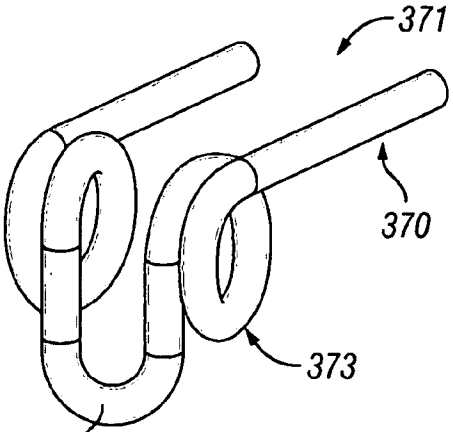
FIGS. 32A-32D show a number of views illustrating an embodiment of a torsion spring that may be used in a recoil reduction system.
Figure 32B:
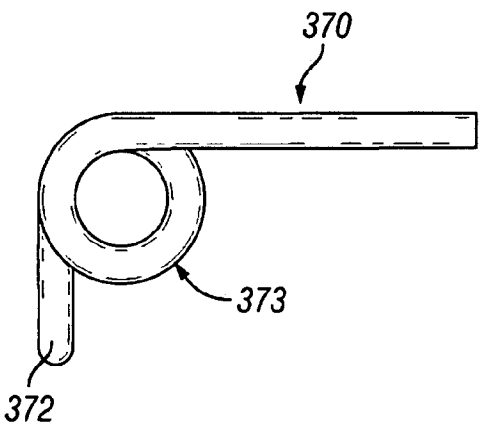
Figure 32C:
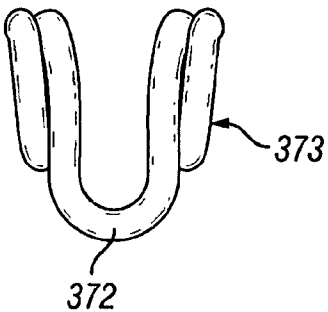
Figure 32D:
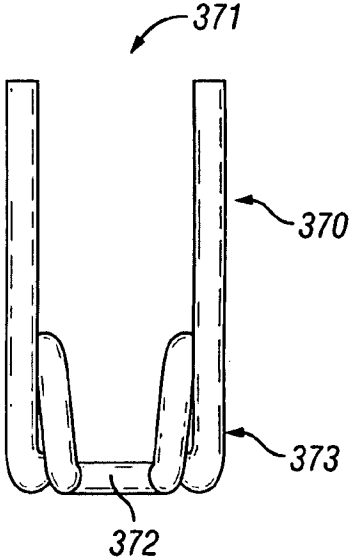

The recoil reduction means illustrated by FIG. 30 further comprises a torsion spring 370. As shown in FIGS. 32A-32D, the torsion spring 370 may have an open end 371 and a closed end 372. The torsion spring 370 may be formed from a single rod of material which may be shaped into two coils 373, with a U-shaped joint in between creating the closed end 372. The coils 373 may be positioned such that the open centers of the coils 373 are parallel to and aligned with each other, as shown in FIGS. 32*b*, 32*c*, and 32*d*. Other torsion spring configurations, such as a single coil torsion spring, would be apparent to one of ordinary skill in the art, given the benefit of this disclosure.

Referring again to FIG. 30, the torsion spring 370 may be connected to the cam 356 by the pivot pin 357 and the closed end 372 of the torsion spring 370 which may be in contact with and captured by a portion of the cam 356. The open end 371 (as best shown in FIG. 32A) of the torsion spring 370 may be captured by a rigid pin 366. In this configuration, the torsion spring may move in the same arc as the cam 356, eliminating or reducing the rebound inherent in systems with traditional spring systems. For example, because the torsion spring 370 pivots about the same axis as the cam 356, all of the recoil energy that is stored in the torsion spring 370 can be used to move a connected firearm back into its pre-discharge position. Conversely, a traditional spring system may oscillate during and after a discharge, changing the direction of the recoil energy rather than absorbing it. This oscillation may introduce another unwanted movement into the firearm, necessitating the use of a dampening means to absorb the energy stored in the spring system, increasing the cost and complexity of the system.

Figure 31:
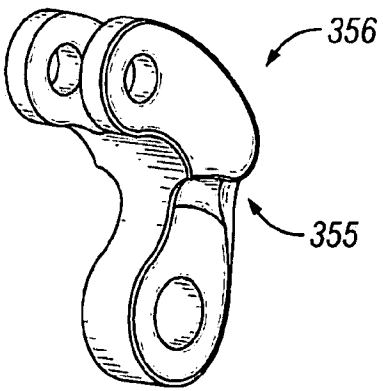
FIG. 31 is a perspective view illustrating an embodiment of a cam that can be used with a torsion spring.

In some embodiments, the cam 356 may be shaped to better conform to the torsion spring 370, as shown in FIG. 31. For example, the cam 356 may include a profile 355 adapted to engage the torsion spring. Other cam configurations, such as non-conformal cams, would be apparent to one of ordinary skill in the art, given the benefit of this disclosure.

The recoil reducing structure may further comprise a cam roller 358 connected to the top end of the cam 356 by pin 359. The top end of the cam 356 may be positioned such that the cam roller 358 is substantially within a cavity 353, formed within the rail 346. The cam roller 358 may contact a wall of the cavity 353, which may pre-stress the torsion spring 370.

The recoil reduction system is configured to oppose rearward travel of the rail 346. For example, when connected to a firearm, the recoil from the firearm, when discharged, may apply a rearward force to the rail 346, causing it to move. Rearward movement of the rail 346 may apply force to the cam roller 358 and thus to the connected cam 356 which will pivot at the pivot pin 357. This movement will stress the torsion spring 370 which advantageously moves in the same arc as the cam 356. As the torsion spring 370 is twisted by the cam 356, the load on the torsion spring 370 increases. This loading of the torsion spring 370 creates a greater resistance to further twisting of the torsion spring 370 and movement of the cam 356, thus reducing the recoil.

As previously discussed, the torsion spring 370 can move in the same arc as the cam 356, therefore the torsion spring 370 can also move within the same space as the cam 356, and may be configured to overlap the cam 356, creating a compact assembly with respect to traditional spring recoil systems. A compact torsion spring 370 and cam 356 assembly may be used advantageously in smaller areas than traditional spring systems and may have fewer moving parts. For example, an elongated forend may have limited space for a recoil reduction system, requiring such systems to be generally flat and run the length of the forend. Prior recoil system adapted for elongated forends have required a number additional moving parts to accommodate the size and shape of the space available within the forend. One example is the embodiment described above and shown in FIG. 17, which requires the extra retainer member 113.

Figure 33:
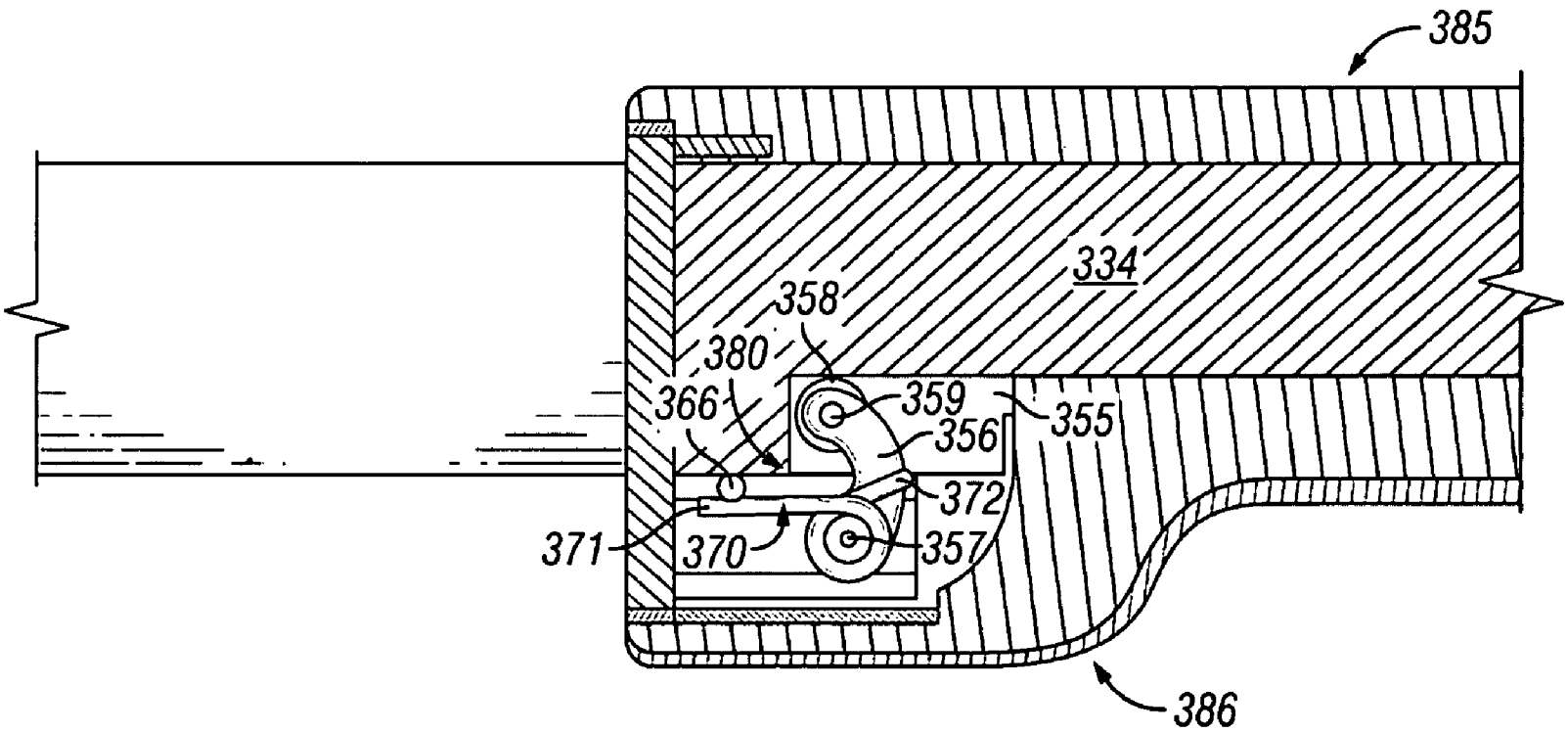
FIG. 33 is a vertical cross section view illustrating an embodiment of a forend, with a recoil reduction system mounted within a recess.

FIG. 33 shows another embodiment of a recoil reduction system which comprises a recoil reduction means connected to a forend 385. The recoil reduction means comprises a torsion spring 370 and cam 356 assembly. The forend 385 comprises a handrest stop 386 which is slidably connected to a firearm and has a recess formed therein. Other configurations and locations for installing the recoil reduction means would be apparent to one of ordinary skill in the art given the benefit of this disclosure.

The cam 356 is pivotally mounted to the forend 385 by a pivot pin 357. The cam 356 may further comprise with a cam roller 358 mounted to the cam 356 with a pin 359. The torsion spring 370 is also mounted to the forend with the pivot pin 357 which may pass through the torsion spring coils 373 (shown in FIGS. 32A-32D) and the cam 356. The closed end 372 of the torsion spring 370 may contact the cam 356. The open end 371 of the torsion spring 370 may be captured by a rigid pin 366. The torsion spring 370 may be pre-loaded. When the firearm is discharged, the cam roller 358 may be engaged by a surface, such as a shoulder 380, of a sliding member 334, causing the cam 356 to pivot, further loading the torsion spring 370 which resists the movement of the sliding member 334, thus reducing recoil.

Figure 34:
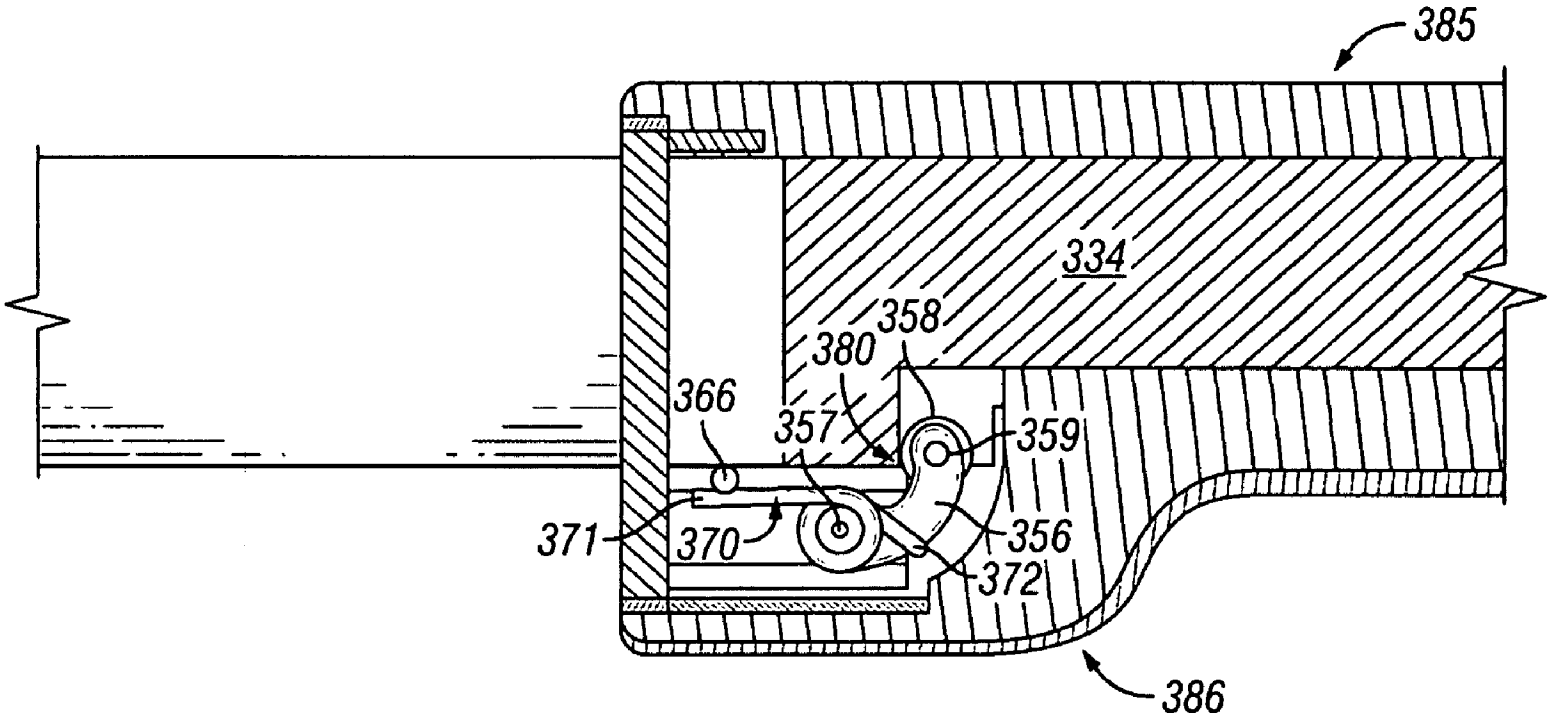
FIG. 34 is a vertical cross section view illustrating an embodiment of a forend, with a recoil reduction system mounted within a recess, during a recoil event.

FIG. 34 shows the recoil reduction system embodiment of FIG. 33 during a recoil event. A force, such as the force from the discharge of a shell, has been applied to the sliding member 334, which has consequently moved rearward. The shoulder 380 of the sliding member 334 has engaged the roller cam 358, and thus the cam 356 which has pivoted about the pivot pin 357. The torsion spring 370 has twisted, moving in the same arc as the cam 356, and has captured energy from the motion of the sliding member 334. The energy captured by the torsion spring from the rearward moving sliding member 334 reduces the recoil perceived by the user and can be used to move the sliding member 334 back to the pre-discharge position.

While this invention has been described in conjunction with the exemplary embodiments outlined above, it is evident that many alternatives, modifications, and variations will be apparent to those skilled in the art.

For example, equivalent elements may be substituted for those specifically shown and described, certain features may be used independently of other features, and the number and configuration of various vehicle components described above may be altered, all without departing from the spirit or scope of the invention as defined in the appended Claims.

Such adaptations and modifications should and are intended to be comprehended within the meaning and range of equivalents of the disclosed exemplary embodiments. It is to be understood that the phraseology of terminology employed herein is for the purpose of description and not of limitation. Accordingly, the foregoing description of the exemplary embodiments of the invention, as set forth above, are intended to be illustrative, not limiting. Various changes, modifications, and/or adaptations may be made without departing from the spirit and scope of this invention.

What is claimed is:

1. A recoil reduction system comprising:

a handgrip member having a top end, bottom end, and a chamber that extends within the handgrip member, wherein a track is formed in the top end of the handgrip member;

a sliding member that is slidably connected to the track; and a recoil reduction mechanism mounted within the chamber, the recoil reduction mechanism comprising a cam, the cam including a pivot aperture, and a torsion spring having at least one coil and being connected to the cam by a pivot pin that is positioned within the at least one coil of the torsion spring and within the pivot aperture of the cam, wherein the recoil reduction mechanism is configured to oppose sliding by the sliding member in at least one direction.

2. The recoil reduction system of claim 1, wherein the sliding member is a rail.

3. The recoil reduction system of claim 1, wherein the recoil reduction system is mounted to a firearm.

4. The recoil reduction system of claim 1, wherein the torsion spring comprises an open end, a closed end, and at least two coils.

5. The recoil reduction system of claim 4, wherein the cam comprises a profile that captures the closed end of the torsion spring.

6. The recoil reduction system of claim 1, wherein the recoil reduction mechanism has substantially no linear rebound.

7. The recoil reduction system of claim 1, further comprising at least one accessory mount connected to the recoil reduction system.

8. The recoil reduction system of claim 7, further comprising a light, sight, scope, laser sight, or bipod connected to at least one accessory mount.

9. The recoil reduction system of claim 1, wherein the cam comprises a cam roller rotatably connected to an end of the cam.

10. The recoil reduction system 9, wherein the sliding member includes a cavity extending into the sliding member, and wherein the cam roller contacts a wall of the cavity.

11. A recoil reduction system comprising:

an elongated forend having a front end, a rear end, a left side wall, a right side wall, a bottom wall, a top end, a recess formed therein, and a track formed in the top end;

a sliding member that is slidably connected to the track; and a recoil reduction mechanism mounted within the recess of the forend, comprising a cam, the cam including a pivot aperture, and a torsion spring having at least one coil and being connected to the cam by a pivot pin that is positioned within the at least one coil of the torsion spring and within the pivot aperture of the cam, which is configured to oppose sliding by the sliding member in at least one direction.

12. The recoil reduction system of claim 11, wherein the forend is connected to a firearm.

13. The recoil reduction system of claim 11, wherein the forend further comprises a handrest stop extending down from the bottom wall of the forend.

14. The recoil reduction system of claim 13, wherein the recess of the forend extends within the handrest stop.

15. The recoil reduction system of claim 11, wherein the torsion spring comprises an open end, a closed end, and at least two coils.

16. The recoil reduction system of claim 11, wherein the recoil reduction mechanism has substantially no linear rebound.

17. The recoil reduction system 11, further comprising a pistol grip that is connected to the bottom wall of the elongated forend.

18. A recoil reduction mechanism comprising:

a cam having a first end, a middle, and a second end, and including a pivot aperture;

a pivot pin pivotally securing the second end of the cam to a firearm;

a torsion spring having at least one coil and being connected to the cam by the pivot pin, the pivot pin being positioned within the at least one coil of the torsion spring and within the pivot aperture of the cam; and a sliding member that is slidably connected to the firearm, wherein the torsion spring and cam assembly is configured to oppose sliding by the sliding member in at least one direction.

19. The recoil reduction mechanism of claim 18, wherein the firearm further comprises;

a receiver having a front end and a rear end;

an elongated gun barrel having a front end and a rear end;

the rear end of the gun barrel being connected to the front end of the receiver;

an elongated magazine for shells, the magazine having a front end and a rear end, the rear end of the magazine being connected to the front end of the receiver;

an elongated forend having a front end, a rear end, a left side wall, a right side wall and a bottom wall, the elongated forend being connected to the elongated magazine; and an upright oriented handgrip having a top end, a bottom end, a front end, and a primary chamber that extends upwardly within the handgrip, and further wherein a track is formed in the top end of the handgrip, wherein the sliding member of the recoil reduction mechanism comprises a longitudinally extending rail connected to the bottom wall of the forend, the rail being slidably received in the track to support the handgrip, and wherein the cam, pivot pin, and torsion spring are mounted in the primary chamber of the handgrip.

20. The recoil reduction mechanism of claim 18, wherein the firearm further comprises;

A receiver having a front end and a rear end;

an elongated gun barrel having a front end and a rear end, the rear end of the gun barrel being connected to the front end of the receiver;

an elongated magazine for shells, the magazine having a front end and a rear end, the rear end of the magazine being connected to the front end of the receiver;

an elongated forend having a front end, a rear end, a left side wall, a right side wall, a top wall, a bottom wall, and a recess formed therein, the elongated forend being connected to the elongated magazine; and wherein the cam, pivot pin, and torsion spring are mounted in the recess.

* * * * *